US006544067B2

(12) United States Patent
Hagmann

(10) Patent No.: US 6,544,067 B2
(45) Date of Patent: Apr. 8, 2003

(54) CABLE CONNECTOR

(75) Inventor: Bernd Hagmann, Geislingen (DE)

(73) Assignee: Hirschmann Electronics GmbH & Co. KG, Neckartenzlingen (DE)

( * ) Notice: Subject to any disclaimer, the term of this patent is extended or adjusted under 35 U.S.C. 154(b) by 0 days.

(21) Appl. No.: 09/864,860

(22) Filed: May 25, 2001

(65) Prior Publication Data

US 2002/0031937 A1 Mar. 14, 2002

(30) Foreign Application Priority Data

May 26, 2000 (DE) ..... 100 26 295

(51) Int. Cl.[7] ..... H01R 4/24
(52) U.S. Cl. ..... 439/404; 439/395
(58) Field of Search ..... 439/404, 391, 439/395, 396, 397–408, 417, 411–416

(56) References Cited

U.S. PATENT DOCUMENTS 4,209,219 A * 6/1980 Proietto ..... 439/404
5,954,541 A * 9/1999 Ozai et al. ..... 439/608
5,989,056 A 11/1999 Lange et al.
6,113,420 A 9/2000 Harting et al. ..... 434/454

FOREIGN PATENT DOCUMENTS

DE 295 12 585 U1 1/1996
DE 197 25 732 A1 1/1999

* cited by examiner

*Primary Examiner*—P. Austin Bradley
*Assistant Examiner*—Ross Gushi
(74) *Attorney, Agent, or Firm*—Fulbright & Jaworski

(57) ABSTRACT

A cable connector includes a core receiving part and a contact carrier joined by a connecting part. The core receiving part houses one or more cores of a cable. The contact carrier is provided with at least one contact element. By means of the connecting part, the core of the receiving part is held in electrical contact with the content element of the contact carrier.

13 Claims, 2 Drawing Sheets

CABLE CONNECTOR

BACKGROUND OF THE INVENTION

1. Field of the Invention

The present invention relates to a cable connector. More particularly, the present invention relates to a multipin cable connector.

2. Description of the Related Technology

DE 295 12 585 U1 discloses a terminal element (cable connector). This terminal element consists of a coupling ring through which a multicore cable is routed. The cable cores, which need not be stripped, are inserted with their ends into the receiving openings in a piece of insulation, by which the ends of the cable cores are deflected out of the lengthwise direction. Afterwards the piece of insulation is connected by a housing flange to the coupling ring. In this installation, insulation piercing connecting devices which are located securely in the housing flange, are connected to the ends of the cable cores. In doing so, the insulation piercing connecting devices penetrate the external insulation of the cable cores and thus establish electrical contact.

One drawback is that the piece of insulation can only be produced with great difficulty and at great expense. Since this insulation piece must not be electrically conductive, it should preferably be made of plastic. In the production of the insulation piece, for example, an injection molding process is used. This injection molding process is very complex in the configuration of the insulation piece as described in DE 295 12 585 U1. It is not easy to eject through the slanted receiving openings for the ends of the cable cores after producing the insulation piece. In other words, complex molds must be prepared to produce the insulating piece because the mold of the insulation piece must have receiving openings that have roughly the same cross section as the ends of the cable cores since these ends must be fixed in the receiving openings so that when the insulation piercing connecting devices are inserted the ends cannot recede, since this would otherwise prevent the making of electrical contact.

SUMMARY OF THE INVENTION

Therefore the object of the invention is to improve a cable connector such that production of the cable connector is facilitated while maintaining simple and prompt assembly.

This and other objects of the invention may be achieved by providing a multipin cable connection having a core receiving part (for holding one or more cores of a cable) and a contact carrier having at least one insulation piercing connecting device for establishing electrical connection between at least one cable core and one contact element.

According to one aspect of the invention, between the core receiving part and the contact carrier there is a connecting part which secures at least one cable core in the core receiving part in a contact-making position. Using the connecting part makes construction of the core receiving part and the connecting part more simple in terms of shape, by which the molds for producing the two parts can also be kept more simple. At the same time, as a result of the simplified shaping and the interplay of the core receiving part with the connecting, part it is guaranteed that the end of at least one cable core is fixed securely in the core receiving part and cannot recede when the insulation piercing connecting device establishes the electrical connection between at least one cable core and one contact element.

According to another aspect of the invention, the core receiving part has at least one core guide configured as a channel which is open to the top. This configuration of the core guide makes it easily possible to implement a core guide which ensures that after inserting the cable cores into the core receiving part these ends of the cable cores are always positioned precisely in the area in which the electrical connection to the insulation piercing connecting device is to be established. In addition, as will be appreciated by one of ordinary skill in the art, a channel which is open to the top can be molded much more easily and removed from the mold as an elongated, closed.

According to another aspect of the invention, the connecting part has a spike which points in the direction of the core receiving part. This spike is designed to press the ends of the cable cores in the channel of the core guide (made open to the top) and to secure them. Using a spike and a wire guide corresponding to its shape, allows simplified shaping, simplified ejection, and defined fixing in the contact-making position.

According to another aspect of the invention, the connecting part has at least one lengthwise slot for guiding at least one insulation piercing connecting device. While the spike of the connecting part is designed to fix the ends of the cable cores in the core guide, the lengthwise slot is designed to guide the insulation piercing connecting device (which is moved through the connecting part) such that electrical connection by means of the insulation piercing connecting device can take place exactly at the site at which the end of the cable core is located. In an especially advantageous manner, in the axial extension of the lengthwise slot of the connecting part the core receiving part also has a lengthwise slot so that the insulation piercing connecting device is guided over a larger part of its lengthwise extension in the core receiving part and in the connecting part and is thus fixed. Accordingly, this effectively prevents the electrical connection between the insulation piercing connecting device and the cable core from being broken. As will be appreciated by one of ordinary skill in the art, this is especially advantageous when the cable connector is exposed to vibrations.

According to another aspect of the invention, the core receiving part is connected via the connecting part to a contact carrier after the cable connector is installed. The connecting part thus has a central function. Specifically, on the one hand, the connecting part secures the ends of the cable cores in the core receiving part and guides the insulation piercing connecting devices of the contact carrier; while on the other hand, the connecting part ensures the connection between the core receiving part and the contact carrier which are thus connected to one another by means of the connecting part. According to one feature of the invention, it is especially advantageous if the aforementioned parts are clipped, welded or cemented to one another since axial installation (which is especially simple to accomplish) is possible. Therefore, as will be appreciated by one of ordinary skill in the art, a screw connection cannot be considered in the embodiment. Alternatively, according to the invention, The connection of the connecting part to the core receiving part and the contact carrier can also comprise the jacket of the cable, especially in the form of strain relief, for example, by the indicated parts and one part of the cable jacket being located in a tube.

BRIEF DESCRIPTION OF THE DRAWINGS

One embodiment of the cable connector according to the invention, to which however the invention is not limited, is described below and explained using the figures, wherein.

DETAILED DESCRIPTION

Figure 1:
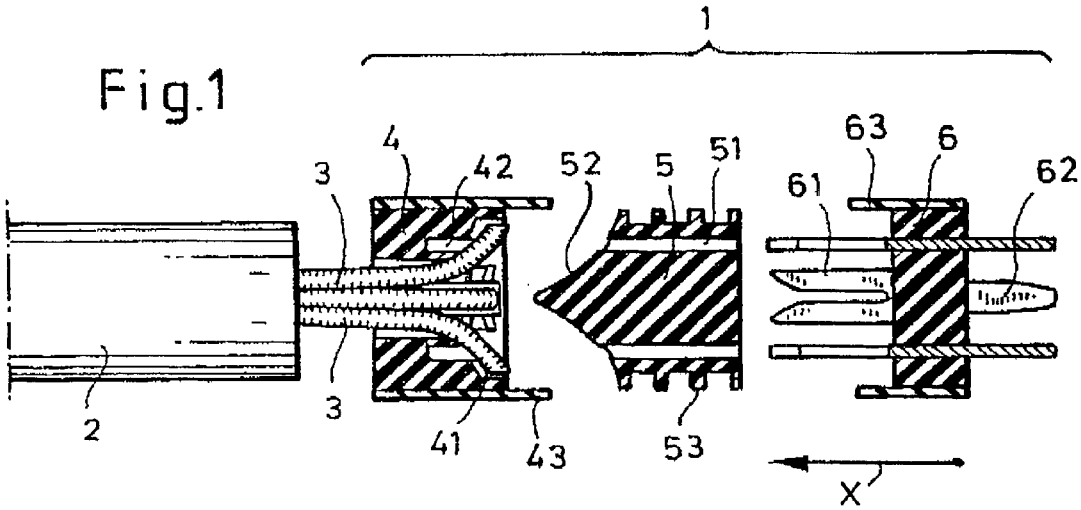
FIG. 1 shows a cable connector in a lengthwise section.

FIG. 1 shows a cable connector 1 with its participating components before their assembly. Contact is to be made between a single-core or multicore cable 2 (in the following a multicore cable 2 is assumed) and the cable connector 1. Contact making can consist in connecting the cable connector 1 to the corresponding part (for example, the cable connector is made as a plug and the corresponding part is a socket), its also being possible to make contact with a electronic circuit, a module, a system or the like by means of the cable connector 1. In addition to electrical contact-making, the cable connector 1, even if not shown in the figures, can additionally be fixed for example by a coupling ring. This fixing can also comprise strain relief of the cable 2.

The cable 2 has several cable cores 3 which with their unstripped ends are inserted into a core receiving part 4 through a central hole (not shown). The core receiving part 4 has one or more core guides 41 which are configured as channels which are made slightly curved and open to the top. Furthermore, the core receiving part 4 has at least one lengthwise slot 42, the number of lengthwise slots 42 depending on the number of the cable cores 3 with which contact is to be made. Moreover, there is provided a peripheral projection 43. The function of the core guides 41, the lengthwise slots 42 and the projection 43 are explained in conjunction with the description of the installation of the cable connector 1.

The cable connector 1 further comprises a connecting part 5 which has lengthwise slots 51 according to the number of cable cores 3. On the end of the connecting part 5, which is pointed in the direction of the core receiving part 4, there is a spike 52. Moreover, on the outside periphery of the connecting part 5 there are several peripheral ribs 53. The function of the lengthwise slot 51, of the spike 52, and of the ribs 53 is likewise explained in conjunction with the discussion of the installation of the cable connector 1.

Finally, there preferably is one more contact carrier 6 which has insulation piercing connecting devices 61 corresponding to the number of cable cores 3. These insulation piercing connecting devices 61 penetrate the contact carriers 6 and end in contacts 62 which are made as flat pins. Generally, the contacts 62 have a function and shape such that they can make contact with the corresponding counterpieces.

Assembly of the cable connector 1 takes place as follows:

The cable cores 3, which can have the same or different diameter, are cropped to a defined length. Then these cable cores are routed through the central hole in the core receiving part 4, by which they move for the most part into the core guide 41. Then the connecting part with its spike 52 is guided in the direction of the core receiving part 4, the spike 52 causing the cables cores 3 to move completely into the core guide 41 and to be fixed by the corresponding shape of the spike 52 in these core guides 41. This is the contact-making length of the cable cores 3. Here the projection 43 of the core receiving part 4 results in its coming into contact with at least one of the peripheral ribs 53 of the connecting part such that the connecting part 5 is fixed with reference to the core receiving part 4. The projection 43 can also be provided with a catch hook which fits behind a rib 53. The contact carrier 6 is then seated on the connecting part 5. The insulation piercing connecting devices 61 of the contact carrier 6 are guided through the lengthwise slot 51 of the connecting part 5 into the area of the core receiving part 4 so that the insulation piercing connecting devices 61 can penetrate the ends of the cable cores 3, i.e. their insulation, in order to establish electrical connection between the cable core 3 and the contact 62. Here again the projection 63 of the contact carrier 6 fits over at least one of the ribs 53 of the connecting part, and the projection 63 can have a catch hook which fits behind one of the ribs 53. Instead of the ribs 53, the connecting part 5 can be provided with recesses into which one or more catch hooks of the core receiving part 4 or of the contact carrier 6 fit. Alternatively, the projections may be located on the connecting part 5 and in the corresponding manner there may be ribs, recesses, or the like on or in the core receiving part 4 and the contact carrier 6. Generally, there must therefore be means with which the location of the core receiving part 4 and of the contact carrier can be fixed to the connecting part 5. The parts can also be welded or cemented to one another, by which it is additionally ensured that the contact-making area is connected and forms a seal. If the parts are mechanically connected to one another, seals can also be inserted at suitable locations.

Furthermore, it is conceivable that after installation of the cable connector 1 it can be surrounded with jacketing, also including the end area of the cable 2.

Figure 2:
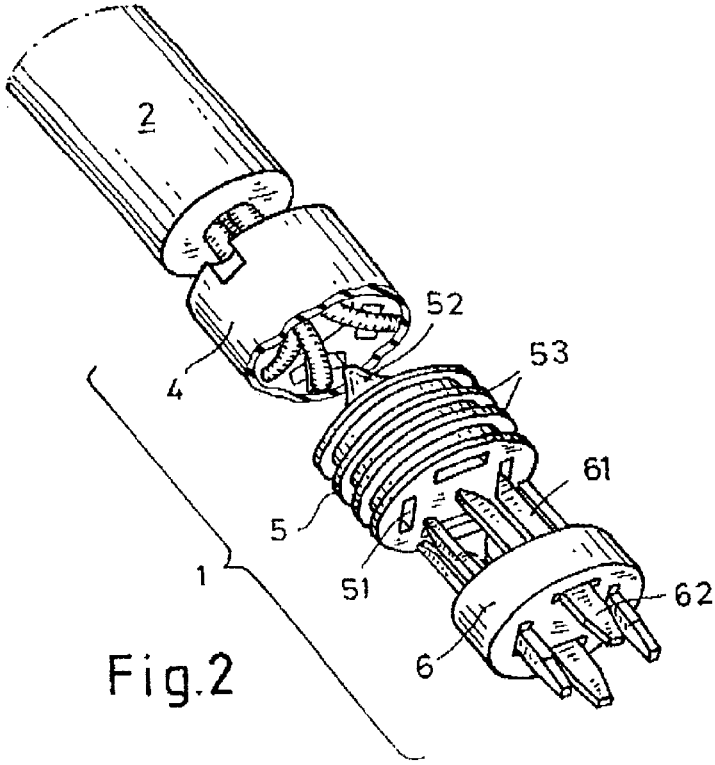
FIGS. 2 and 3 show different three-dimensional views of the cable connector as claimed in the invention.
Figure 3:
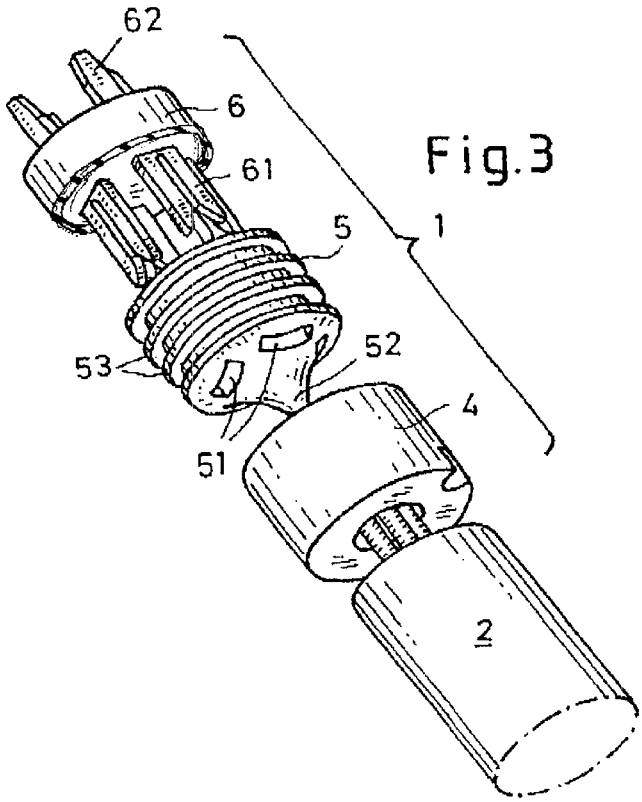

FIGS. 2 and 3 show various three-dimensional views of an embodiment of the cable connector 1 of the present invention before installation. It can be clearly seen that here, for example, a four-core cable 2 is used. Depending on the number of cores, the core receiving part 4, the connecting part 5 and the contact carrier 6 are made accordingly.

What is claimed is:

1. A cable connector comprising:

a core receiving part adapted to retain one or more cores of a cable so that an end portion of each core is retained in different directions that are turned away from a longitudinal axis of the cable;

a contact carrier having at least one contact element;

a connecting part disposed between said core receiving part and said contact carrier, said connecting part disposed and configured to retain an end portion of at least one core in said core receiving part in a core guide configured as a channel that is open in the direction of said connecting part so the end portion of the at least one core is retained in the channel in a direction that is turned away from the longitudinal axis of the cable, the end portion of the at least one core is retained in the channel by said connecting part being disposed over the open portion of the channel with the at least one contact element of said contact carrier being in electrical contact with the retained end portion of the at least one core;

wherein said connecting part includes a spike portion extending toward said core receiving part, said spike portion providing a surface against which the at least one core is retained in said channel.

2. The cable connector of claim 1, wherein said contact carrier includes at least one insulation piercing connecting device.

3. The cable connector of claim 2, wherein the connecting part includes at least one lengthwise slot for guiding at least one of said at least one insulation piercing connecting devices.

4. The cable connector of claim 1, wherein said channel has a smooth interior surface in which the at least one core is retained.

5. A cable connector comprising:

a core receiving means for retaining one or more cores of a cable with an end portion of each core retained in said core receiving means so as to be turned in a direction away from that of a longitudinal axis of the cable;

a contact carrier means for carrying at least one contact element; and a connecting means for retaining the end portion of at least one cable core in said core receiving means and for guiding at least one contact element to said core receiving means to be in electrical contract with the retained end portion of the at least one core; and at least one core guide means for retaining said cable core in said core receiving means;

wherein said connecting means includes a spike means for retaining said cable core in said core guide means.

6. The cable connector of claim 5, wherein said core guide means is configured as a channel which is open in the direction of said connecting means.

7. The cable connector of claim 5, further comprising insulation piercing means for piercing insulation of said core.

8. The cable connector of claim 7, wherein said connecting means includes slot means for guiding said insulation piercing means toward retained cores in said core receiving means.

9. A method for connecting to a cable core comprising;

inserting at least one core of a cable into a core receiving part so said core is retained in said core receiving part and said core is turned in a direction away from a longitudinal axis of the cable;

attaching a connecting part to said core receiving part so the attached connecting part is disposed to secure said core in said core receiving part;

attaching a contact carrier to said connecting part, said contact carrier when attached to said contact carrier having at least one contact element disposed to be in electrical contact with the retained at least one core;

piercing insulation adjacent said core with an insulation piercing connecting device disposed from said contact carrier; and, positioning a spike portion of said connecting part to retain said core in said receiving part.

10. A cable connector comprising:

a core receiving means for retaining one or more cores of a cable with an end portion of each core retained in said core receiving means so as to be turned in a direction away from that of a longitudinal axis of the cable;

a contact carrier means for carrying at least one contact element;

a connecting means for retaining the end portion of at least one cable core in said core receiving means and for guiding at least one contact element to said core receiving means to be in electrical contract with the retained end portion of the at least one core; and at least one core guide means for retaining said cable core in said core receiving means;

wherein said connecting means includes a spike means for retaining said cable core in said core guide means, and said spike means extends toward said core receiving means to provide a surface for retaining the at least one cable core in said core guide means.

11. A cable connector comprising:

a core receiving part adapted to retain one or more cores of a cable so that an end portion of each core is retained in different directions that are turned away from a longitudinal axis of the cable;

a contact carrier having at least one contact element; and a connecting part disposed between said core receiving part and said contact carrier, said connecting part disposed and configured to retain an end portion of at least one core in said core receiving part in a core guide configured as a channel that is open in the direction of said connecting part so the end portion of the at least one core is retained in the channel in a direction that is turned away from the longitudinal axis of the cable, the end portion of the at least one core is retained in the channel by said connecting part being disposed over the open portion of the channel with the at least one contact element of said contact carrier being in electrical contact with the retained end portion of the at least one core;

wherein said connecting part includes at least two peripheral ribs encircling and disposed about the outside surface of said connecting part such that one of said peripheral ribs is in contact with a first projection extending from said core receiver part and the other of said peripheral ribs is in contact with a second projection extending from said contact carrier.

12. A cable connector comprising:

a core receiving means for retaining one or more cores of a cable with an end portion of each core retained in said core receiving means so as to be turned in a direction away from that of a longitudinal axis of the cable;

a contact carrier means for carrying at least one contact element; and a connecting means for retaining the end portion of at least one cable core in said core receiving means and for guiding at least one contact element to said core receiving means to be in electrical contract with the retained end portion of the at least one core;

wherein said connecting means includes a first peripheral rib means for retaining a first projection extending from said core receiver means so that said connecting means is disposed to retain each core in said receiving means, and said connecting means further includes a second peripheral rib for retaining a second projection extending from said contact carrier means so that said contact element is retained in electrical contact with the end portion of the retained at least one core.

13. A method for connecting to a cable core comprising;

inserting at least one core of a cable in to a core receiving part so said core is retained in said core receiving part and said core is turned in a direction away from a longitudinal axis of the cable;

attaching a connecting part to said core receiving part so the attached connecting part is disposed to secure said core in said core receiving part;

attaching a contact carrier to said connecting part, said contact carrier when attached to said contact carrier having at least one contact element disposed to be in electrical contact with the retained at least one core; and, attaching a first peripheral rib extending from said connecting part to a first projection extending from said core receiving part to accomplish the attachment of said connecting part to said core receiving part, and attaching a second peripheral rib extending from said connecting part to a second projection extending from said contact carrier to accomplish the attachment of said connecting part to said contact carrier.

* * * * *